US011768063B2

(12) United States Patent
Pierce

(10) Patent No.: US 11,768,063 B2
(45) Date of Patent: Sep. 26, 2023

(54) ARROW USING CORING HEAD AND RODS

(71) Applicant: Huw Glynne Pierce, Houston, TX (US)

(72) Inventor: Huw Glynne Pierce, Houston, TX (US)

( * ) Notice: Subject to any disclaimer, the term of this patent is extended or adjusted under 35 U.S.C. 154(b) by 0 days.

(21) Appl. No.: 17/746,534

(22) Filed: May 17, 2022

(65) Prior Publication Data

US 2022/0373311 A1 Nov. 24, 2022

Related U.S. Application Data

(60) Provisional application No. 63/190,698, filed on May 19, 2021.

(51) Int. Cl.
*F42B 6/04* (2006.01)
*F42B 12/36* (2006.01)

(52) U.S. Cl.
CPC ..... *F42B 12/362* (2013.01); *F42B 6/04* (2013.01); *F42B 12/367* (2013.01)

(58) Field of Classification Search
CPC ..... F42B 6/04; F42B 6/06; F42B 6/08; F42B 12/362
See application file for complete search history.

(56) References Cited

U.S. PATENT DOCUMENTS 3,150,875 A 9/1964 Searles
4,722,531 A 2/1988 Schram
4,772,029 A * 9/1988 Watkins ..... F42B 6/04 473/578
4,772,531 A * 9/1988 Tsukahara ..... G03F 7/0285 430/254
4,795,165 A * 1/1989 Tehan ..... F42B 6/04 473/578
4,836,557 A * 6/1989 Polando ..... F42B 12/362 473/578
5,465,980 A * 11/1995 Maurin ..... F41H 13/0006 473/578
6,238,310 B1 5/2001 Morrison
7,909,714 B2 * 3/2011 Cyr ..... F42B 6/06 473/578
8,388,473 B2 3/2013 Smith
8,764,589 B1 * 7/2014 Thompson ..... F42B 6/04 473/585
8,784,242 B2 * 7/2014 Gendregske ..... F42B 6/04 473/581
8,905,875 B1 12/2014 Long
9,194,670 B2 11/2015 Gendregske
11,473,886 B1 * 10/2022 Pierce ..... F42B 6/04
(Continued)

*Primary Examiner* — John A Ricci
(74) *Attorney, Agent, or Firm* — Jason C. Cameron

(57) ABSTRACT

An arrow with a first body having a cylindrical member with a first outside diameter, a first outer surface, a first inner diameter, a first proximate end, and a first distal end, where the first proximate end is configured to accept an arrowhead, a second body having a hollow cylindrical member, where the second distal end is configured to accept fletching, and a nock, and a connecting means to couple the first body to the second body, wherein the arrowhead is a hollow coring arrowhead configured to cut a volume of material through a target, and where mass and fluid passes through the coring arrowhead to the first body, and where one or more rods are positioned within the second body, where the rods are exposed to the target after the first body detaches from the second body.

18 Claims, 14 Drawing Sheets

(56) References Cited

U.S. PATENT DOCUMENTS

| | | | | |
|---|---|---|---|---|
| 2008/0051231 | A1 | 2/2008 | Everett | |
| 2008/0248903 | A1* | 10/2008 | Cyr | F42B 12/68 473/575 |
| 2014/0256481 | A1* | 9/2014 | Flint | F42B 6/04 473/578 |
| 2016/0025465 | A1 | 1/2016 | Emery | |
| 2019/0234719 | A1 | 8/2019 | Twomley | |

* cited by examiner

300

SLITS

SLITS W/ SCALLOPS

ANGLED SCALLOPS

LATITUDINAL GROOVES

SPIRAL STRAND COMPOSITION

WOUND CAVITY EXAMPLES

CORING ARROW LEADING EDGE DETAILS

RODS – OVERALL CONCEPT

WOUND CAVITIES USING MULTIPLE RODS

ARROW USING CORING HEAD AND RODS

CROSS-REFERENCES TO RELATED APPLICATIONS

The present application is related to and claims priority to the following co-pending application, the entirety of which is incorporated by reference herein: U.S. Provisional Patent Application Ser. 63/190,698 (Attorney Docket No. 2021-1702), entitled "Arrow With Coaxial Body Elements" filed May 19, 2021.

STATEMENT REGARDING FEDERALLY SPONSORED RESEARCH OR DEVELOPMENT

Not applicable.

TECHNICAL FIELD

The, present invention relates generally to a device, system, and method used for hunting animals. More particularly, the present invention relates to a device, system, and method for rapid dispatching of game animals in a hunting environment using an arrow.

BACKGROUND

Arrows have been used to hunt and dispatch animals, both land- and water-based, throughout human history. Early arrows used a sharpened point of a stick to penetrate an animal, with the goal of hitting a vital organ or break a bone. When using sharpened sticks to hunt game, a hunter would need to hit an animal multiple times over an extended period before the animal was subdued. In many instances, the animals being hunted were dangerous and unpredictable, especially when the animals were wounded from one or more previous arrow hits.

As technology developed, arrow technology also grew. More advanced bows were developed to fire an arrow further, straighter, and with more force. The arrows themselves became more accurate and more lethal with the introduction of balanced arrow bodies, razor-tipped arrowheads, fletching to stabilize the arrow in flight, and advanced construction materials to enable the arrow to fly faster and with more accuracy over longer distances.

Current hunting procedures involve shooting an arrow into an animal with the goal of killing (dispatching) the animal as quickly as possible to minimize the animal's pain and suffering. Furthermore, an animal that is dispatched quickly does not run as far, making tracking easier. In many cases, the animal is not aware that it has been hit. In a significant number of instances, the arrow passes completely through the body of the animal. Immediately after an animal is hit, the hunter must wait for the animal to expire, often through blood loss. This procedure requires anywhere from a few minutes to an hour or longer for the animal to collapse. The hunter is then tasked with tracking a potentially dangerous and wounded animal, often in difficult territory and unfavorable weather conditions. If the animal wanders away without being found, the hunter often attempts to shoot another animal in order to gain a trophy, reach his game limit, or use up his license tag.

What is needed is a device and a method that can rapidly dispatch an animal, both to reduce the time between arrow impact and animal collapse, and also to humanely kill the animal in the quickest possible time as to minimize the animal's pain and suffering.

SUMMARY

The illustrative embodiments provide a device, system, and method. An embodiment includes an arrow with a first body having a cylindrical member with a first outside diameter, a first outer surface, a first inner diameter, a first proximate end, and a first distal end, where the first proximate end is configured to accept an arrow head, a second body having a hollow cylindrical member with a second outside diameter, a second inner diameter, a second outer surface, a second inner surface, a second proximate end, and a second distal end, where the second distal end is configured to accept fletching, and a nock, and a connecting means to couple the first body to the second body, where the connecting means establishes a linear alignment of the first body to the second body along the device's longitudinal axis, and where the connecting means permits the first body to be removable in relation to the second body.

An embodiment also includes a system that includes a target animal, a bow for shooting arrows, an arrow device made of a first body having a cylindrical member with a first outside diameter, a first outer surface, a first inner diameter, a first proximate end, and a first distal end, where the first proximate end is configured to accept an arrow head, a second body having a hollow cylindrical member with a second outside diameter, a second inner diameter, a second outer surface, a second inner surface, a second proximate end, and a second distal end, where the second distal end is configured to accept fletching, and a nock, and a connecting means to couple the first body to the second body, where the connecting means establishes a linear alignment of the first body to the second body along the device's longitudinal axis, and where the connecting means permits the first body to be removable in relation to the second body, and a blood trail, responsive to an impact of the arrow upon the animal, where the blood trail is used to track the animal.

An embodiment includes a method for rapid dispatching of an animal that includes hitting the animal with an arrow, where the arrow is made of a first body having a cylindrical member with a first outside diameter, a first outer surface, a first inner diameter, a first proximate end, and a first distal end, where the first proximate end is configured to accept an arrow head, a second body having a hollow cylindrical member with a second outside diameter, a second inner diameter, a second outer surface, a second inner surface, a second proximate end, and a second distal end, where the second distal end is configured to accept fletching, and a nock, and a connecting means to couple the first body to the second body, where the connecting means establishes a linear alignment of the first body to the second body along the device's longitudinal axis, and where the connecting means permits the first body to be removable in relation to the second body. The method also includes penetrating, by the arrow head, the animal, where the arrow head causes tissue damage and creates a wound cavity with associated blood loss, responsive to the arrow hitting the animal, decelerating, by the second body, where the second body maintains the wound cavity to prevent closure of the wound cavity and provide a path for unrestricted blood flow, separating the first body from the second body, where the first body separates due to a lower drag value than a drag value of the second body, and dispatching of the animal due to the wound cavity and associated blood loss.

BRIEF DESCRIPTION OF THE DRAWINGS

Certain novel features believed characteristic of the invention are set forth in the appended claims. The invention itself, however, as well as a preferred mode of use, further objectives and advantages thereof, will best be understood by reference to the following detailed description of the illustrative embodiments when read in conjunction with the accompanying drawings, wherein:

FIGS. 2A, 28, 2C, and 2D depict a plurality of connecting means between a leading arrow and a lagging, arrow in accordance with an illustrative embodiment;

DETAILED DESCRIPTION

Figure 1:
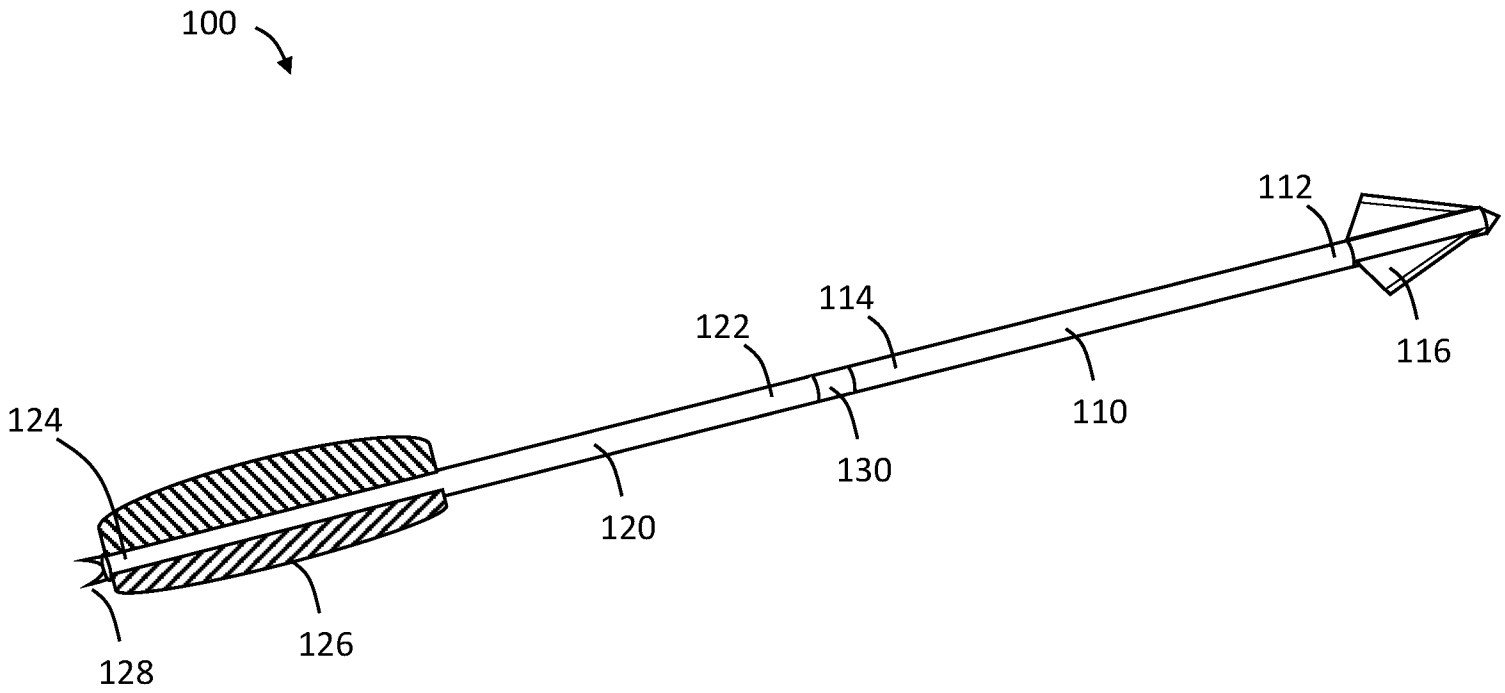
FIG. 1 depicts an arrow with two coaxial body elements connected together in accordance with an illustrative embodiment.

The following disclosure provides many different embodiments, or examples, for implementing different features of the provided subject matter. Specific, examples of components and arrangements are described below to simplify the present disclosure. These are, of course, merely examples and are not intended to be limiting. For example, the formation of a first feature over or on a second feature in the description that follows may include embodiments in which the first and, second features are in direct contact and may also include embodiments in which additional features may be positioned between the first and second features, such that the first and second features may not be in direct contact. In addition, the present disclosure may repeat reference numerals or letters in the various examples. This repetition is for the purpose of simplicity and clarity and does not in itself dictate a relationship between the various embodiments or configurations discussed.

Further, spatially relative terms, such as "beneath," "below," "lower," "above," "upper" and the like, may be used herein for case of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

The present disclosure may be better understood, and its numerous features and advantages made apparent to those skilled in the art by referencing the accompanying drawings. The use of the same reference symbols in different drawings indicates similar or identical items.

FIGS. 1-7 illustrate devices, systems, and methods for a coaxial arrow device for use in hunting animals with several features that are novel and unique. According to some embodiments, the coaxial arrow rapidly dispatches the target animal quickly and humanely. Other embodiments are possible and are not limited by the examples discussed in this disclosure.

FIG. 1 depicts a coaxial arrow 100 having two coaxial body elements connected together in accordance with an illustrative embodiment. Arrow 100 includes a first body (leading arrow) 110, a second body (lagging arrow) 120, an arrow head 116, a connecting member 150, fletching 126, and a nock 128. The leading arrow 110 has a first proximate end 112 and a first distal end 114, where the first proximate end 112 is mechanical fastened the arrow head 116. The mechanical fastening of the arrow head 116 to the first proximate end 112 of leading arrow 110 is of any commercially viable means, to include but not limited to screw-socket arrangement, adhesives, a friction fit, and the like. According to some embodiments, the body of the leading arrow 110 is in the form of a cylinder that is a solid mass. In some embodiments, the leading arrow 110 cylinder is made of a hollow cylinder, or a combination of a hollow cylinder and a solid cylinder. Other designs are possible and are not limited herein. The choice of using a hollow cylinder or a solid cylinder is dependent upon design goals of weight distribution, blood channel design, strength, material availability, and the like. In yet other embodiments, leading arrow 110 and lagging arrow 120 can have a square cross-section, triangular cross-section, or other shapes while still conforming to the embodiments disclosed herein. In the present embodiment, leading arrow 110 is displayed as a solid cylinder with a socket at the first proximate end 112 and an opening to accept the connecting member 150 at the first distal end 114. In some embodiments, the arrow head 116 is attachable and detachable through the use of threads on the arrow head 116 and a threaded socket located on the first proximate end 112 of the leading arrow 110. Other embodiments are possible and are not limited by this disclosure.

Continuing with FIG. 1, the lagging arrow 120 includes a second proximate end 122 and a second distal end 124. The second proximate end 122 is mechanically connected to the first distal end 114 of the leading arrow 110 through the use of a connecting member 150. According to some embodiments, the lagging arrow 110 is directly connected to the lagging arrow 120 without the use of a connecting member 150 through the use of a friction fit, a shear pin, adhesives, adhesive tape, and the like. The leading arrow 110 and the lagging arrow 120 are aligned along a common longitudinal axis and are held to mechanically rigid during transport, the act of shooting, and during flight through the air. Leading arrow 110 and lagging arrow 120 can be constructed of plastic, phenolic, metal, wood, carbon fiber, and the like. In the present disclosure, leading arrow 110 is constructed of solid or hollow aluminum cylinder while lagging arrow 120 is constructed of extruded aluminum in the shape of a straw. The arrow 100 also includes the arrow head 116.

Lagging, arrow 120 includes a nock 128 mechanically fastened to the second distal end 124. The nock 128 permits a bow string to be securely positioned at the second distal end 124 during the act of shooting the arrow. According to some embodiments, the nock 128 is made of plastic, metal, carbon fiber, and the like and is mechanically attached to the lagging arrow 120 through the use of glues, threads, tape, an interference fit, a friction fit, and the like. Other embodiments are possible and are not limited by these examples. Lagging arrow 120 also includes fletching 126 that are used to provide aerodynamic stability and guidance during flight. Fletching 126 are attached to the lagging arrow 120 through the use of adhesives, screws, and the like. In some embodiments, fletching 126 can be located on the leading arrow 110, or on both the leading arrow 110 and the lagging arrow 120.

The connecting member 150 mechanically connects the leading arrow 110 to the lagging arrow 120 and maintains mechanical strength and alignment of the two arrows while allowing the separation of the leading arrow 110 from either the connecting member 150 or the lagging arrow 120 upon impact of the arrow 100 with the target animal. As disclosed herein, arrow 100 can be constructed without a connecting member 150 by mechanically attaching leading arrow 110 with lagging arrow 120 through the use of screw threads, tape, adhesive, a friction fit, and the like. In some embodiments, the connecting member 150 is designed to break upon impact, with none, some, or all pieces of the broken connecting member 150 staying with the leading arrow 110 after separation. In yet other embodiments, the connecting member 150 is configured to be hollow, perforated, or a combination of both hollow and perforated to allow blood flow from the animal through the interior of the hollow lagging arrow 120.

In some embodiments, lagging arrow 120 also includes packing material (not shown) within the inner surface, where the packing material is used to enhance blood flow using a "wicking" effect to draw blood from the wound cavity, through the lagging arrow 120, and out of the lagging arrow 120. The packing material is constructed of cloth, synthetic fiber, and the like to absorb and transport blood away from body tissues and through the lagging arrow 120, thus improving arrow 100 performance in quickly dispatching the animal. According to some embodiments, the package material can be treated with chemicals to affect blood flow such as flux or other chemicals or drugs for a variety of effects.

In some embodiments, the length of the leading arrow 110 in relation to the length of the lagging arrow 120 is a ratio from approximately 0.0 to approximately 1.0. In some embodiments, the ratio of leading arrow 110 length to lagging arrow 120 length is approximately 0.20. Spoken another way, the leading arrow 110 can be 10% of the length of lagging arrow 120, or the lagging arrow 120 can be half the length of leading arrow 110. Other ratios are possible, and are not limited by these examples. The varying ratio of leading arrow 110/lagging arrow 120 lengths can affect flight and impact performance, terminal ballistics after impact, and post-impact wound cavity creation.

According to some embodiments, the lagging arrow 120 creates a fluid/gas chamber (not shown) due to the hollow nature of the hollow cylinder used in the construction of the lagging arrow 120. The fluid/gas chamber can be used to store gas pressure, as when the arrow 100 impacts the animal, thus providing additional force to the leading arrow 110 in an effort to enhance the separation of the leading arrow 110 from the lagging arrow 120.

Figure 2A:
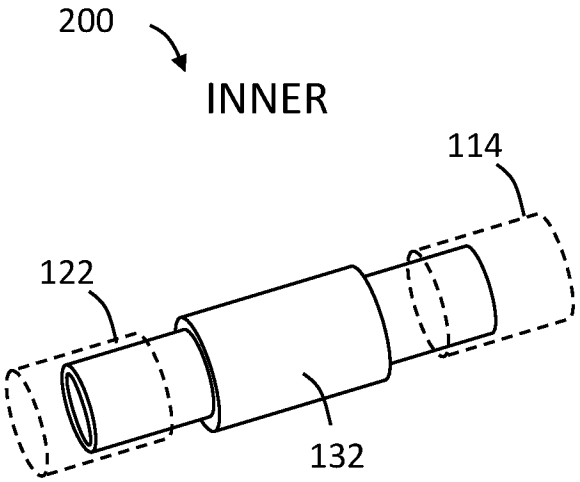
Figure 2B:
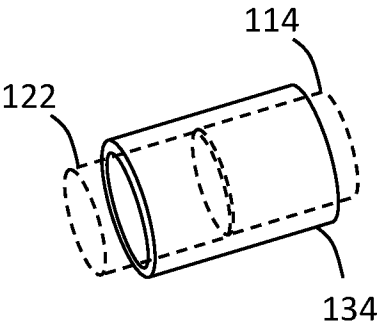
Figure 2C:
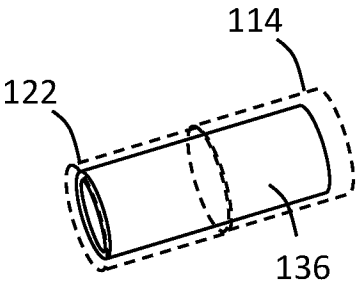
Figure 2D:
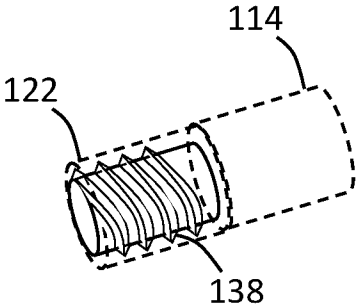

FIGS. 2A, 2B, 2C, and 2D depict a plurality of designs 200 for a connecting means 150 in accordance with an illustrative embodiment. FIG. 2A discloses an "inner" connecting member 132 with two inner mating surfaces that placed inside the leading arrow 110 and the lagging, arrow 120 in a mechanical arrangement. Meanwhile, FIG. 213 discloses a "outer" connecting member 134 that fits over and around the first distal end 114 of leading arrow 110 and the second proximate end 172 of lagging arrow 120. FIG. 2C shows the "hidden" connecting member 136 is hidden from view once installed between the leading arrow 110 and the lagging arrow 120. Finally, FIG. 2D discloses a threaded connection between the lagging arrow 120 and the connecting member 132 using threads 138. In some embodiments, the threads 138 are designed to shear away, and/or unthread, upon impact with the animal, thus allowing the leading arrow 110 to separate from the lagging arrow 120. In other embodiments, the thread 138 orientation is configured in coordination with the orientation of the fletching 126 to ensure the arrow 100 does not inadvertently unscrew, or disassemble, during flight.

The connecting member 150 can be of a different color and material than other parts of the arrow 100. In some embodiments, the connecting member 150 can also contain a trademark or other identifying color, symbol, or mark, or contain a location to add a label as needed. According to some embodiments, the connecting member 150 is reusable, while in yet other embodiments, the connecting member 150 is destroyed during the act of separation and thus is not reusable. These are just a few examples of use; other embodiments are possible and are not limited by this disclosure.

In operation, each connecting member 150, and connecting members 132, 134, and 136, can be mechanically fastened to the leading arrow 100 and the lagging arrow 120 in a manner described herein to allow the leading arrow 110 to separate from either the connecting member 150 or the lagging arrow 120 upon impact with an animal. This process of separating the two arrows can be accomplished by disassembly, breakage of connecting member 150, or by using a pre-designed breaking point in the connecting member 150 that allows breakage upon a predetermined amount of force on the connecting member 150, as experienced when an arrow 100 impacts an animal.

Figure 3A:
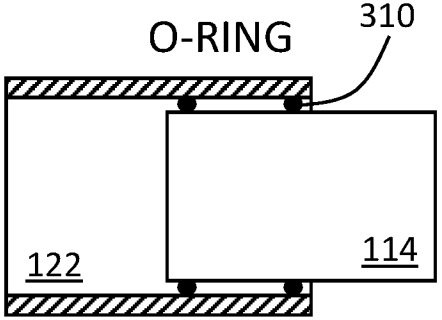
FIGS. 3A, 3B, 3C, 3D, 3E, 3F, 3G, and 3H depict fastening methods to connect the leading arrow to the lagging arrow in accordance with an illustrative embodiment.

FIGS. 3A, 3B, 3C, 3D, 3E, 3F, 3G, and 3H depict fastening methods to connect the leading arrow 110 to the lagging arrow 120 using the connecting member 150 in accordance with an illustrative embodiment. In all FIG, 3A-3F examples, the lagging body 120 second proximate end 122 is larger in diameter than the leading arrow 110 first, distal end 114 as shown in the FIGS. However, these fastening methods also work, for other embodiments. e.g., when using the connecting member 150, or when the leading arrow 110 diameter is larger than the lagging arrow 120 diameter. FIG. 3A discloses one or more O-rings 310 positioned between the leading arrow 110 and the lagging arrow 120. According to some embodiments, positional grooves or tracks exist in either or both of the surfaces to aid in location and placement of the O-rings 310.

Figure 3B:
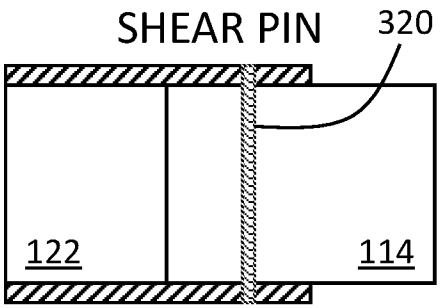

FIG. 3B discloses adding a shear pin 320 in a hole drilled through both the first distal end 114 and the second proximate end 122. The shear pin 320 is designed to break at a predetermined stress level corresponding to the impact of the arrow 100 on an animal.

Figure 3C:
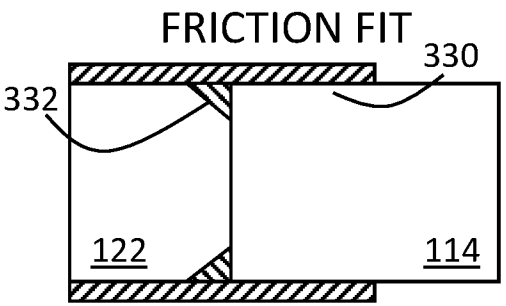

FIG. 3C shows a friction fit design where the first distal end 114 fits snugly inside the second proximate end 122. In some embodiments, a mechanical stop 332 is added to the second proximate end 122 to form a positive position verification method for positioning the first distal end 114 properly.

Figure 3D:
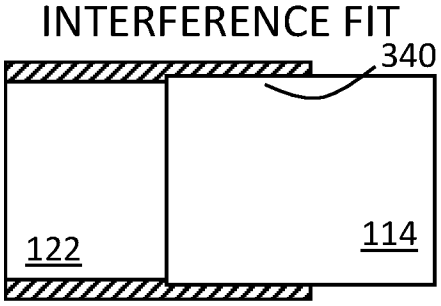

FIG. 3D shows an interference fit 340 between the first distal end 114 and the second proximate end 122. The first distal end 114 is sized to be equal to, or slightly larger than the interior diameter of the second proximate end 122. When mechanically assembled, the first distal end 114 pushes the second proximate end 122 wider and ensuring a tight fit with proper measurement and assembly, the interference fit will ensure mechanical reliability, longitudinal axis alignment, and separation strength without the use of additional hardware or assembly steps.

Figure 3E:
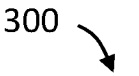
Figure 3E:
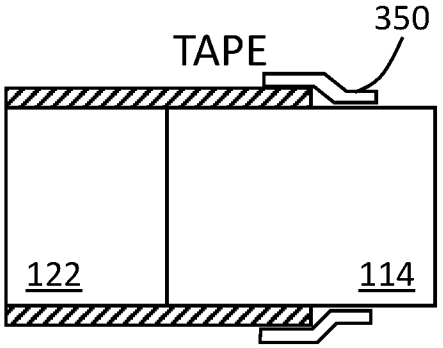

FIG. 3E shows adhesive tape 350 being used to affix the first distal end 114 to the second proximate end 122. In this example, a shrinking material can also be used in place of adhesive tape.

Figure 3F:
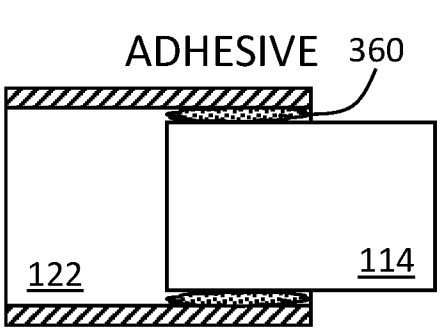

FIG. 3F shows adhesive being used in the space between the two bodies to ensure mechanical rigidity and longitudinal axis alignment while in use.

Figure 3G:
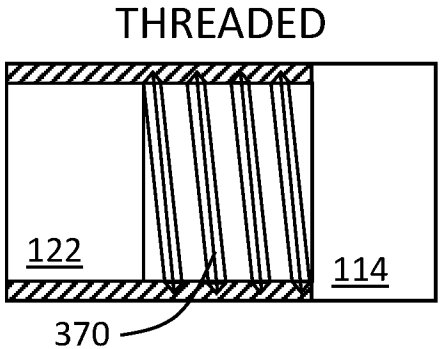

FIG. 3G shows a threaded arrangement between the leading arrow 110 distal end 114 and the lagging arrow 120 proximate end 122. As described earlier (lagging arrow 120 with connecting member 132), this figure shows threads that are designed to hold the arrow 100 together during flight yet allow the leading arrow 110 to break away from the lagging arrow 120 upon impact.

Figure 3H:
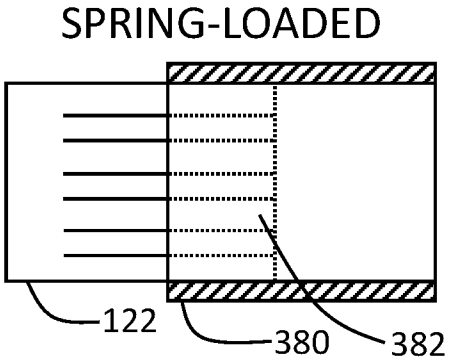

Finally, FIG. 3H spring-loaded splines 382 positioned inside the distal end 114 of leading arrow 110. In this example, the leading arrow 110 is dimensionally larger in width than the lagging arrow 120 proximate end 122. The splines 382 can be part of the lagging arrow 120 body that are formed by cutting slots in the proximate end 122 of the lagging body 120. In other embodiments, the splines 382 are a separate component of arrow 100. According to some embodiments, the splines are under tension or compression to aid in holding the leading arrow 110 to the lagging arrow 120.

Figure 4A:
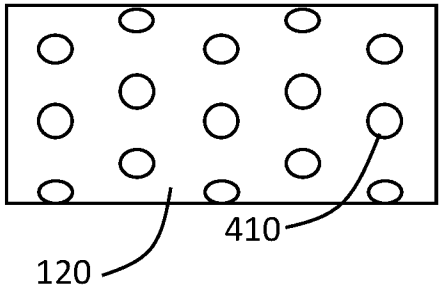
FIGS. 4A, 4B, 4C, 4D, 4E, 4F, 4G, 4H, 4I, and 4J depicts perforations on a lagging arrow in accordance with an illustrative embodiment.

FIGS. 4A, 4B, 4C, 4D, 4E, 4F, 4G, 4H, 4I, and 4J depict perforations on the lagging arrow 120 in accordance with an illustrative embodiment. FIG. 4A shows a plurality of holes 410 drilled in the lagging arrow 120 along the length of the surface. The holes 410 allow the passage of blood to flow from the wound cavity, through the holes 410, through the interior of the lagging arrow 120, and out of the animal or to other interior regions of the, animal. According to yet other embodiments, the hole 410 edges are sharpened to aid in cutting material from the wound cavity while the lagging arrow 120 is moving through the animal.

Figure 4B:
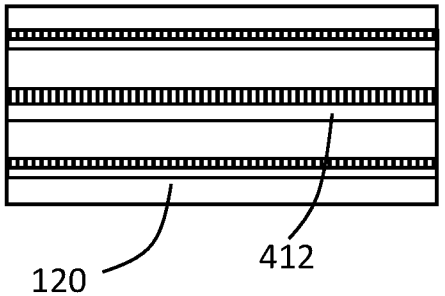

FIG. 4B shows a blood groove 412 on the outside surface of the lagging arrow 120. The groove 412 performs two functions: first it allows for a channel for blood to flow from the wound cavity to other parts of the animal, and second, the groove 412 prevents the wound cavity from reclosing around the lagging arrow 120 and restricting the blood flow from progressing. According to some embodiments, there is a plurality of, grooves on the outside surface of the lagging arrow 120. According to other embodiments, the grooves are present on the outside surface of the entire arrow 100. According to yet other embodiments, the grooves 412 are V-shaped, U shaped, and the like. According to yet other embodiments, the groove 412 are arranged in a spiral pattern, a parallel pattern an intersecting pattern, and the like.

Figure 4C:
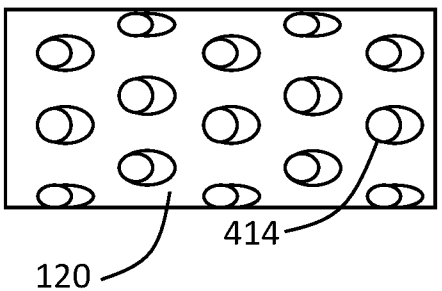

FIG. 4C shows a plurality of scallops 414 on the outside surface of the lagging arrow 120. The scallops 414 provide both a cutting surface and a hole for first cutting material and then enhancing blood flow of a wound cavity as described herein.

Figure 4D:
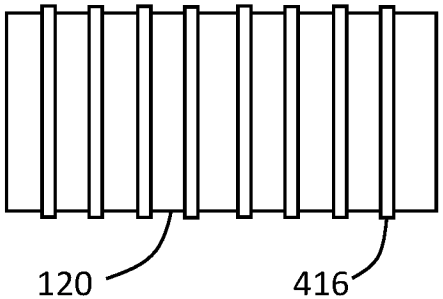

FIG. 4D shows a series of ridges 416 on the outside surface of the, lagging arrow 120. The ridges perform two functions: first, the ridges 416 add significant drag and friction to the lagging arrow 120 in an effect to enhance deceleration of the lagging arrow 120 when an animal is hit. Second, the ridges 416 maintain physical distance of the wound cavity from the surface lagging arrow 120 in an effort to prevent the collapse of the wound cavity upon the lagging arrow, thus avoiding restricting blood flow form the wound cavity.

Figure 4E:
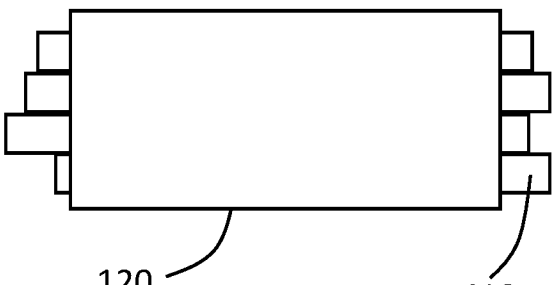

FIG. 4E shows a plurality of rods 418 located within the interior of the lagging arrow 120. The rods 418 can be made of any material, including, but not limited to metal, fiberglass, plastic, phenolic, wood, and the like. The purpose of the rods 418 is to cause additional damage to the animal, both from causing multiple wound paths and to further enhance blood flow. In operation, the rods 418 are released once the leading arrow 110 separates from the lagging arrow 120 after impact. Once the lagging arrow 120 starts to decelerate, the rods 418 are free to continue moving forward due to their own inertia. Each rod 418 can take their own trajectory and, in some embodiments, will spread out in a fan- or expanding-cone pattern. In some instances, the rods 418 bend and twist as they travel through the animal, thus causing more damage. According to some embodiments, the rods 418 can be flat faced, sharpened to a point, hollow and can be of any length. In some embodiments, the rods 418 are packed under tension and/or compression thus allowing the rods 418 to separate and travel radially outwards from the lagging body 120 upon release. According to yet other embodiments, the rods 418 can be fastened or not fastened to the lagging body 120. When fastened, the rods 418 can be removed by backing out the lagging body 120 from the animal. When not fastened, the rods 418 must be individually found and removed from the body.

Figure 4F:
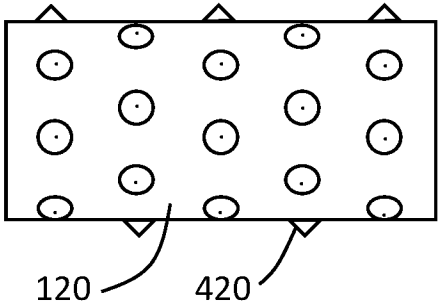

FIG. 4F shows a plurality of graters 420 positioned on the lagging arrow 120. The graters 420 are designed to enhance wound cavity damage and blood flow, and to add to the lagging arrow 120 in slowing down while inside'wound cavity.

Figure 4G:
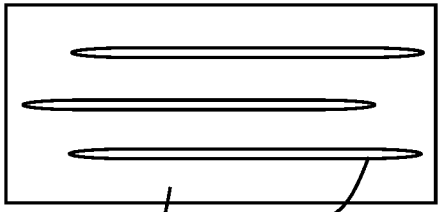

FIG. 4G shows a plurality of slits 422 located along the longitudinal axis of the arrow 100. In some embodiments, the slits 422 are positioned at an angle to the longitudinal axis of the arrow 100, or orthogonal to the arrow's 100 flight path. The slits can be manufactured by cutting, laser, pressing, grinding, and the like.

Figure 4H:
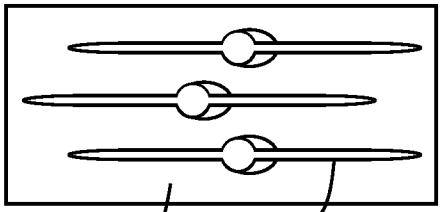

FIG. 4H shows a plurality of slits combined with scallops or slit/scallops 424.

Figure 4I:
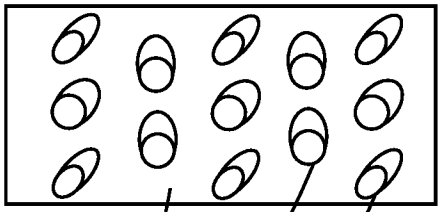

FIG. 4I discloses angled scallops 426. The angled scallops 426 can be positioned at any angle in relation to the longitudinal axis of the arrow 100. In some embodiments, the angled scallops 426 are oriented to the expected rotation motion of the arrow 100 due to the twisting of the arrow 100 in flight and after impact with the animal.

Figure 4J:
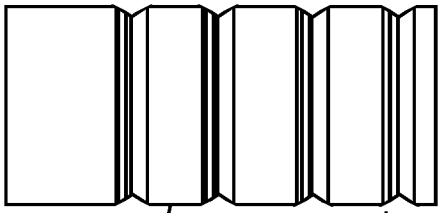

Finally, FIG. 4J displays a series of latitudinal grooves 430. The latitudinal grooves 430 perform the same function as the longitudinal grooves 412 of FIG. 4B, that is to maintain the wound cavity after the arrow 100 impacts the animal.

Continuing with FIGS. 4A-4J, one or more of these design features can be combined to form additional designs. Other designs are possible and are not limited by the examples disclosed herein.

Figure 5:
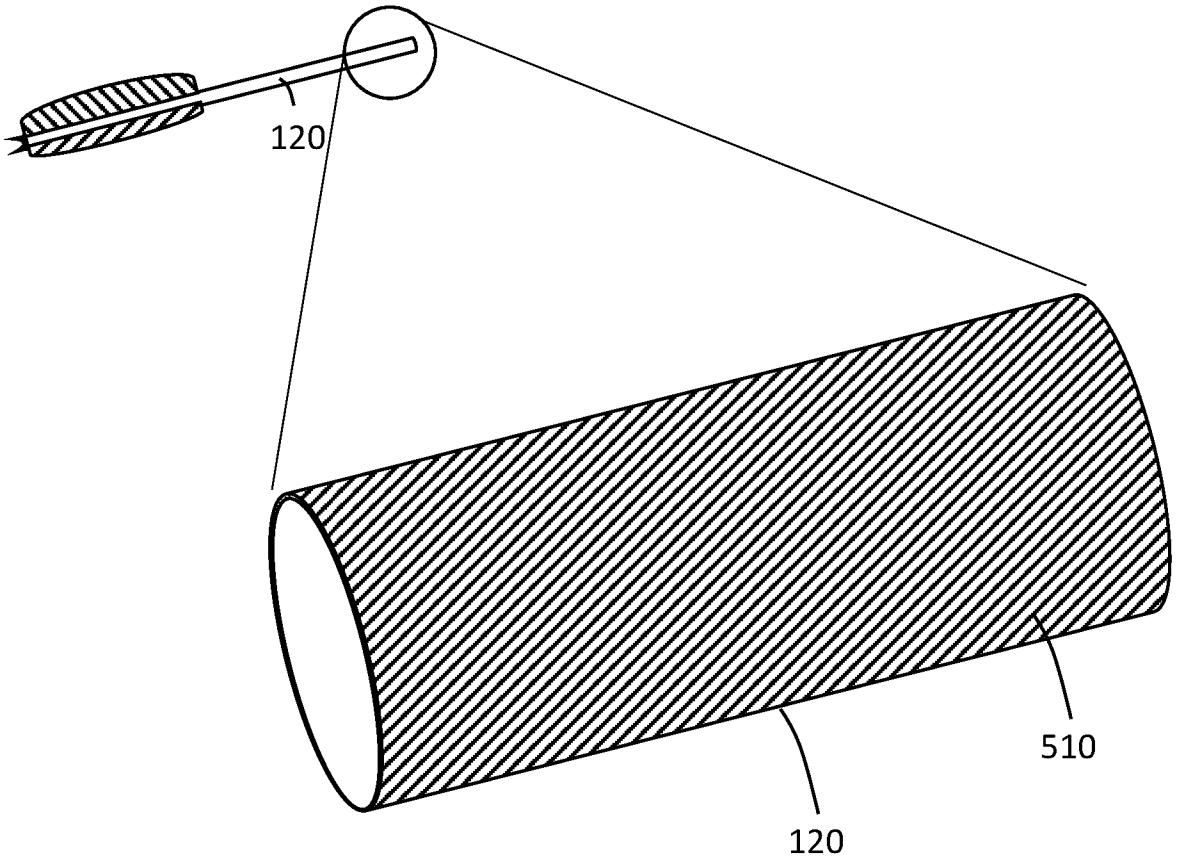
FIG. 5 depicts an arrow body composed of stranded separable spiral elements in accordance with an illustrative embodiment.

FIG. 5 depicts an arrow body 100, shown as lagging body 120 (of FIG. 1) composed of stranded separable spiral elements in accordance with an illustrative embodiment. The spiral elements 510 can be made of carbon fiber, plastic, phenolic, paper, and the like. The spiral elements 510 is constructed to withstand handling forces and aerodynamic forces while in flight but breaks apart once the animal is hit with the arrow 100. The lagging body 120 using spiral elements 510 in its construction can decelerate very quickly due to twisting and turning motion felt by the lagging body 120 once the animal is hit. As a result of being twisting and turning, the lagging arrow 120 becomes larger and results in a higher drag value. According to some embodiments, the orientation of the spiral elements 510 is positioned relative to the fletching 126 in such a way that centrifugal forces imparted on the arrow 100 by the orientation of the fletching 126 contributes to the destructive nature, of the spiral elements 510. Spoken another way, when the fletching 126 imparts a clockwise spin to the arrow 100 in flight, the spiral elements 510 are positioned in a counterclockwise orientation such that, upon impact, the centrifugal inertia of the arrow 100 aids in tearing apart the spiral elements 510. According to some embodiments, spiral elements 510 can be constructed with known and deliberate weak points to aid in defining break points within the lagging body 120. These weak points can be made of weak glue, thinner material, laser or other mechanical indentations, perforations, and the like.

Figure 6:
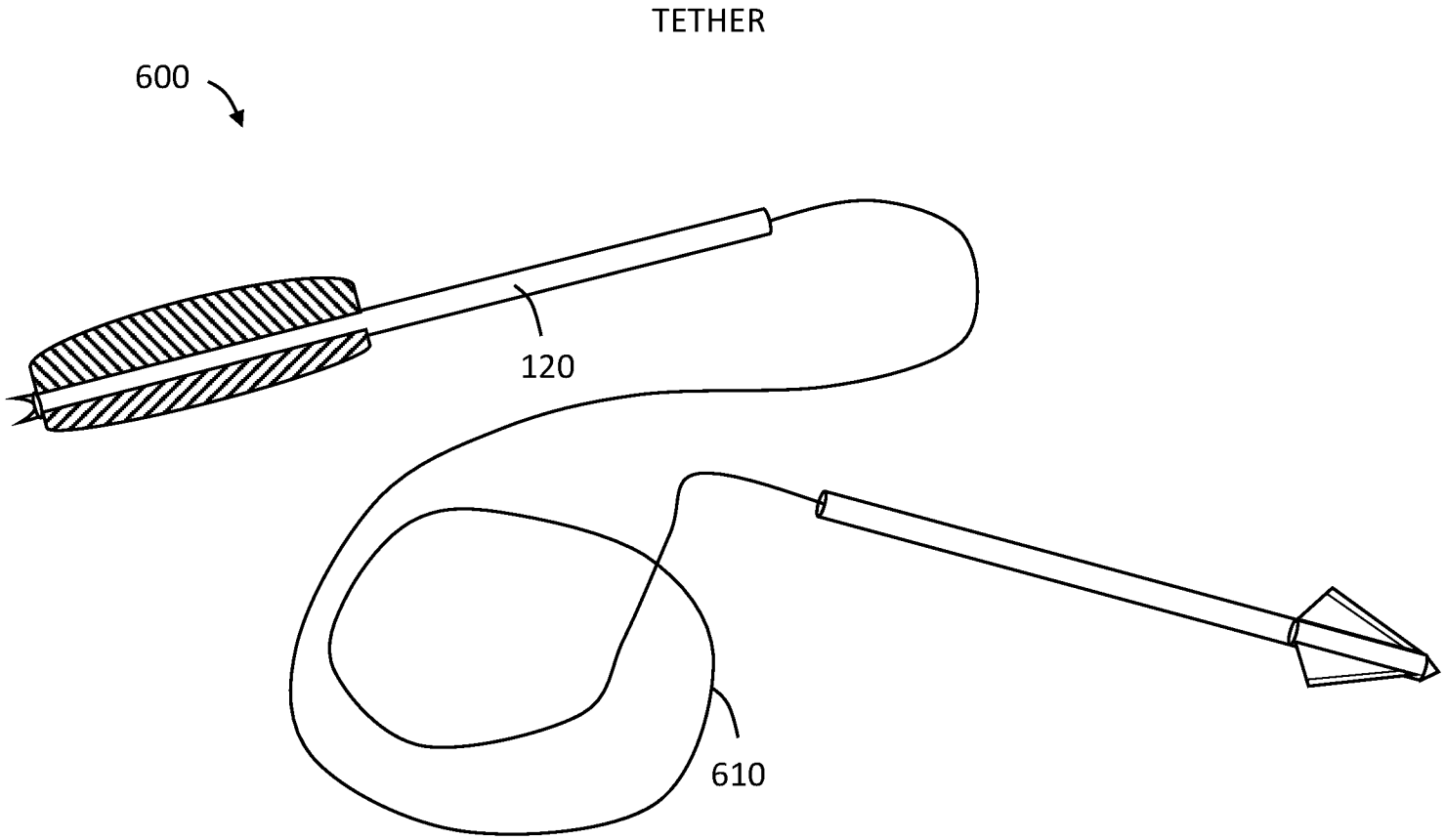
FIG. 6 depicts a thread connecting a leading arrow and lagging arrow in accordance with an illustrative embodiment.

FIG. 6 depicts a scenario 600 with arrow 100 with a tether 610 connecting the leading arrow 110 to the lagging arrow 120 in accordance with an illustrative embodiment. The thread can be of any reasonable length, for example, 10 yards or 25 yards. These examples are merely representative and other lengths are possible. The thread can be a wire, cord, spring, monofilament, carbon fiber, cable, string, metal cable, and, rope. Other embodiments are possible and are not limited to these examples. The tether 610 can be colorless or be colored with bright or florescent dyes or paints. In some embodiments, the thread is stored in a coiled shape in the lagging arrow 120. However, embodiments exist where the tether 610 is stored in the connecting member 150 or the leading arrow 110. According, to some embodiments, the tether 610 is rigid and without any significant elasticity, while in other embodiments, the tether 610 is highly elastic. A highly elastic tether 610 can extend the wound cavity of an animal, and also aid in snaring the wounded animal to nearby terrain such, as trees and bushes.

According to some embodiments, the tether 610 is connectively fastened to the aft distal end of leading arrow 110. In, other embodiments, the tether 610 is contained in a chamber in the leading arrow 110 and is released once impact with an animal has occurred. In some embodiments, the tether is connected to the inside surface of the lagging arrow 120, but other embodiments are possible and are not limited by these examples.

In use, the tether 610 performs at least four functions. First, the tether 610 is used to retain the leading arrow 110 after the arrow 100 is broken into two parts. In some embodiments, it is desirable to recover said leading arrow 110 after a shot is taken. Second, during a hunt and after an animal is hit, the tether 610 will be a visible trace for a hunter to follow. Third, the tether 610 can be used to entangle the animal, with surrounding terrain (bushes, trees, and the like) to aid in restraining the animal after impact and separation of the arrow 100. Finally, as the tether 610 is still attached to both the leading arrow 110 and the lagging arrow 120, animal movement after the leading arrow 110 has hit the terrain will cause additional damage to the animal since the lagging arrow 120 is still within the animal and being pulled by the attached tether 610. This results in yet additional damage to the animal and hastening its demise.

Figure 7:
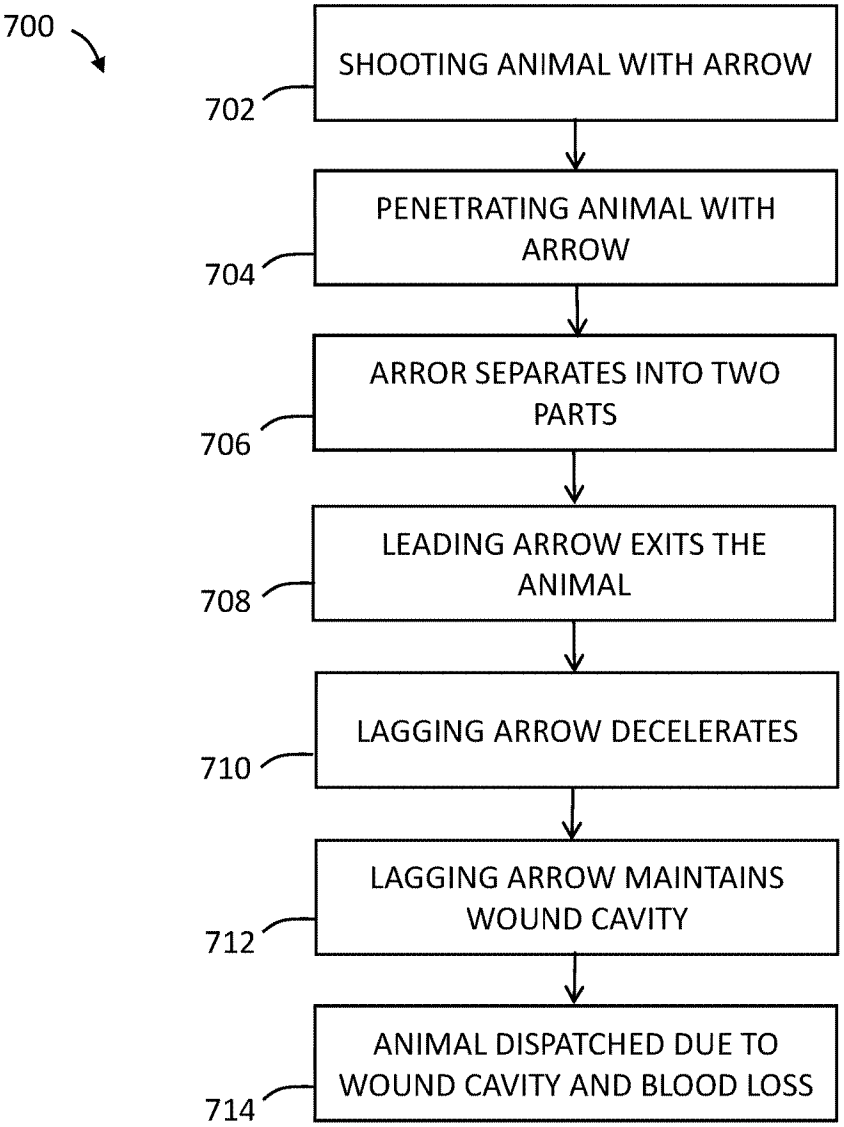
FIG. 7 depicts steps of a method for rapid dispatching of an animal using a coaxial arrow in accordance with an illustrative embodiment.

FIG. 7 depicts steps of a method 700 for rapid dispatching of an animal using a coaxial arrow 100 with separable sections in accordance with an illustrative embodiment. Method 700 begins at step 702 where a user releases the bowstring of a bow to shoot an arrow 100 towards a target animal. Method 700 continues at step 704 where the arrow 100 impacts the animal and begins to penetrate the animal's body. The arrow head 116 causes damage to the animal through the use of cutting edges resulting in a first wound cavity resulting in blood flow within and outside of the animal's body. The first wound cavity primarily consists of incisions that bleed at a moderate rate. Next, at step 706, as the arrow 100 fully enters the animal's body, the higher drag of the lagging arrow 120 causes the lagging arrow 120 to slow down relative to the leading arrow 110. The resultant drag difference causes the lagging arrow 120 to separate from the leading arrow 110. Next, at step 708, as the leading arrow 110 continues with a known velocity and minimal drag through the animal, the leading arrow 110 continues cutting material as it travels through the animal's body, and then the leading arrow 110 exits the animal's body and continues traveling through the air for a distance. Next, at step 710, as the lagging arrow 120 separates from the leading arrow 110, the force of impact with the animal results in deceleration of the lagging arrow 120 with the goal of retaining the lagging arrow 120 within the animal's body. At step 712, the resultant larger surface area of the lagging arrow 120 creates a second wound cavity that is larger, and bleeds more than the first wound cavity. During deceleration, the lagging arrow 120 also becomes deformed and results in a larger surface area, thus creating additional deformation and frontal surface area while inside the animal. The result is a larger second wound cavity within the animal that contributes to the blood loss by the animal. Finally, at step 714, the animal collapses and expires from a combination of blood loss from the first wound cavity, blood loss from the second wound cavity, and damage to tissue and structures within the animal body due to the impact of the arrow 100.

In an alternative embodiment, the arrow 100 also includes one or more rods located within the interior of the arrow 100, such as within the lagging arrow 120. The rods can take the form of a bunch or rods or pins. The rods can be made of carbon fiber material, metal, phenolic, plastic, or any likewise material. In use, as the arrow 100 hits and then moves through the animal, the leading arrow 110 separates from the lagging arrow 120. As it does so, a string, such as tether 610 pulls out one or more rods from the second proximate end 112 of the lagging arrow 120. The resultant introduction of a number of rods within the wound cavity, while the lagging arrow 120 is still moving, causes the rods to spread out, or "porcupine" into surrounding tissue and creates a massive wound cavity in multiple directions at once. As a result, the wound cavity is massive, with multiple small channels and each small channel a separate blood source for rapid bloodletting of the animal.

According to some embodiments, the arrow 100 also includes an insertable payload cartridge. The insertable payload cartridge resides in any part of the arrow 100 to include the leading arrow 110, the lagging arrow 120, or the connecting member 150. The insertable payload cartridge can contain any of a number of items, including, but not limited to a tracking circuit, a homing beacon, an audible beeper, a strobe or other light, a chemical signal, a OPS transceiver, a cell phone-capable system, pyrotechnics, a flare, signaling gear, medicine, compressed gas cartridge, and the like. Furthermore, the insertable payload cartridge can also include a trigger that is set off immediately upon impact or after a predetermined delay.

According to some embodiments, the arrow 100 also includes a coring arrow head 116 alone, or in combination with a hollow leading arrow 110. The coring head/body operated by cutting and removing a cross-sectional region of the animal in an effort to create additional damage as well as enhancing blood flow and blood loss by creating a cylindrical cavity exit wound. In at least some embodiments, the core diameter is determined by the sizing and dimensions of the core diameter itself. Thus configured, the resultant coring damage can vary depending on the specific need of the user and the animal being impacted. According to some embodiments, the coring arrow can include a coring an-ow head or a coring arrow body, such as lagging body 120 of arrow 100.

In some exemplary embodiments, the coring arrow has an opening on the first proximate end 114 of the leading arrow 110. In some instances, the flying arrow builds up air pressure within the arrow body. In one embodiment, the air pressure can be used to decelerate the arrow body upon impact, while in other embodiments, small air holes are placed on the arrow body to prevent the build-up of air pressure within the arrow body. In yet other embodiments, the accumulating air pressure within the arrow body is used to aid in decelerating the body after impact.

Figure 8:
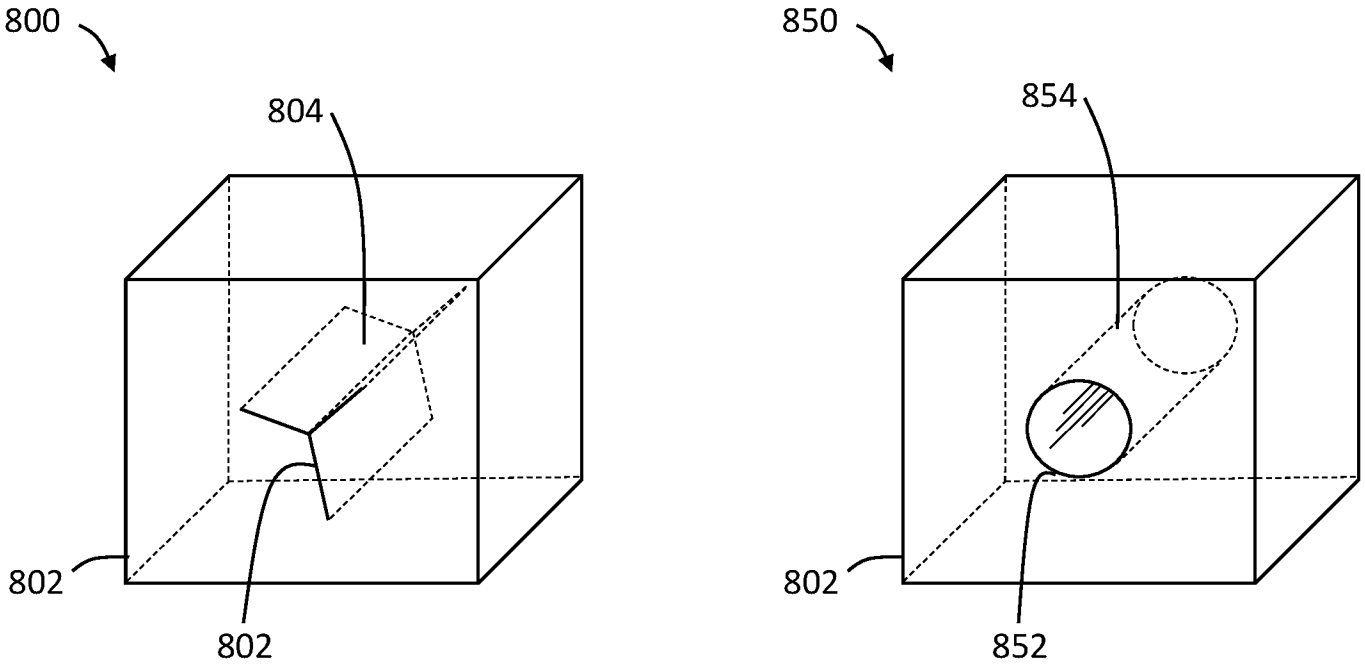
FIG. 8 depicts wound cavities caused by the passage of broadheads and a coring head in accordance with an, illustrative embodiment.

FIG. 8 depicts two wound cavities 800 and 850 caused by the passage of a razor-tipped broadhead and a coring head in accordance with an illustrative embodiment. FIG. 8 includes a target mass 802 that is representative of a target animal body containing a vital region. The vital region can include blood vessels, vital organs, muscle mass, and the like.

It is highly desirable to dispatch the target animal quickly and efficiently for several reasons. First, the suffering of the target animal should be minimized to ensure a humane hunt. Second, present hunting techniques have the hunter waiting, after hitting an animal with an arrow, for a period of 20 minutes or more to wait for the animal to bleed out, lay down, and expire. These techniques necessarily extend the length of the hunt, increasing the probability of losing track of the animal, and the potential extended suffering of the animal. Furthermore, the animal can run away, often out of sight, and may "bed down" in a hidden location, making tracking and detection difficult and sometimes impossible. Finally, merely wounding an animal sometimes causes the animal to become enraged and dangerous. Thus, a hunter tracking a wounded animal often confronts an animal that attacks the hunter with horns, tusks, teeth, or antlers and can injure or kill the hunter. Thus, it is beneficial to quickly dispatch the animal as quickly and humanely as possible. In many instances, the animal can be dispatched without the animal even aware that they have been hit by an arrow.

Therefore, it is desirable to faun a massive wound cavity in a target animal while using an arrow to ensure the animal drops quickly and without an extended chase. Continuing with FIG. 8, a traditional slit wound cavity 800 shows a typical wound impact point 802 created when a three-bladed arrowhead hits the target animal. The three blades broadhead produces a three-pointed star pattern that also creates a three-faceted wound cavity 804, Such a wound cavity 804 does produce some bleeding, especially when the wound cavity intersects with a major artery or organ. However, it is common knowledge that once the passage of the arrow through the animal is completed, the sides of wound cavity 804 closes in upon itself. In many instances, the potential blood flow is reduced, while in other instances, the blood flow stops altogether. While such a wound is often severe or even fatal, it might take minutes or hours for the target animal to lose blood and to collapse or expire. This is not satisfactory to a hunter who desires the animal to drop immediately and not suffer little or at all.

Figure 9:
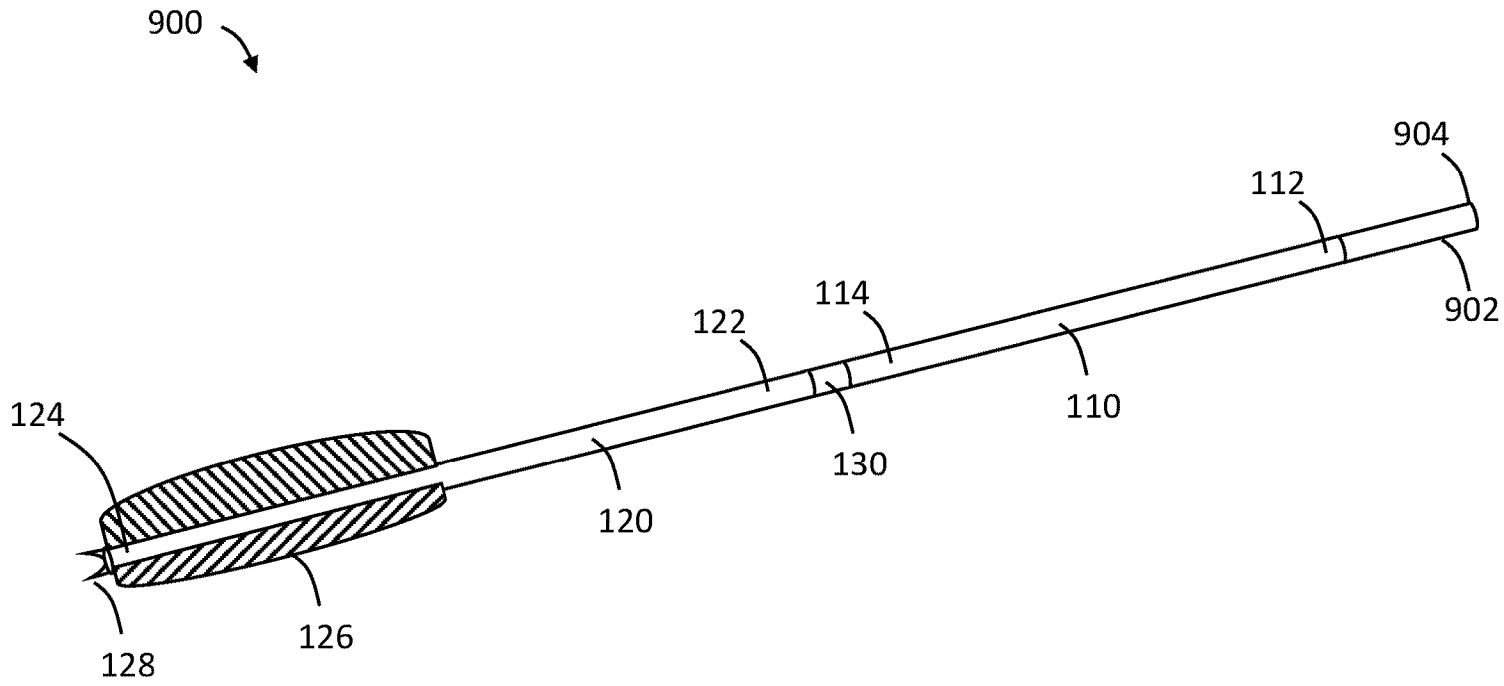
FIG. 9 depicts an arrow body having a leading coring arrowhead in accordance with an illustrative embodiment.

Next, the present disclosure describes a roughly cylindrical wound cavity 850 as created by a coring arrowhead as described in FIG. 9. The roughly cylindrical open wound cavity 850 includes a coring arrowhead impact area 852 and shows an open wound cavity area 854 that is created by removing a mass of material from the animal. Furthermore, when an open wound cavity 854 is created, there is much less likelihood that the sides of the wound will close up upon itself as in the slit wound cavity 800. The result is a massive wound that bleeds rapidly from both the area created by the passage of the arrowhead and the inability of the open wound cavity 854 from closing in upon itself.

The open wound cavity area 854 greatly enhances the potential blood loss and damaging effects of an arrow impact with a target animal. In the present embodiment, the open wound cavity 854 allows for greater blood loss and a higher probability of hitting and destroying a vital organ or blood vessel in the animal, thus allowing for a greater likelihood of rapid uncontrolled blood loss. Associated with rapid blood loss is the effect of rapidly dispatching the animal and reducing or even stopping any further flight of the animal. Thus, forming an open wound cavity 854 in an animal permits a more humane hunt and a rapidly dispatched animal. Therefore, it is highly desirable to shoot the target animal with an arrowhead that creates a wound that bleeds rapidly and cannot close by itself such as open wound cavity 854.

FIG. 9 depicts an arrow body having a coring arrowhead 900 in accordance with an illustrative embodiment. The coring arrow 900 is similar to the previously disclosed arrow 100 of FIG. 1; however, the broadhead 116 is instead replaced with a hollow coring arrowhead 902 having a leading edge 904. In some embodiments, the coring arrowhead is fixable attached to the leading arrow body 110 at the proximate end 112 by use of adhesive, threads, and the like. In yet other embodiments, the coring arrowhead 902 is hollow allowing the passage of material and fluids to pass through the center of the coring arrowhead 902. In yet other embodiments, the coring arrowhead 902 has a sharpened leading edge 904. The leading edge 904 can also be rounded, flat, serrated, notched, frangible, treating with, friction-reducing treatments, and the like.

In some embodiments, the coring arrowhead 902 includes a safety covering over the leading edge 904 to protect the hunter during routine transport and use. The protective covering could be a rubber or plastic sheath, a cloth or leather bag, or the like. The sheath would be removed immediately before a hunt begins to ensure the safety of the hunter.

In operation, the coring arrowhead 902 creates a roughly cylindrical wound cavity, such as wound cavity 850 of FIG. 8. As the coring arrowhead 902 passes through the animal, mass and fluids such as muscle and blood are cut away from the animal and carried through the hollow coring arrowhead 902. After the coring arrowhead 902 passes through the animal, an open wound cavity is left behind, such as described in FIG. 8.

Figure 10:
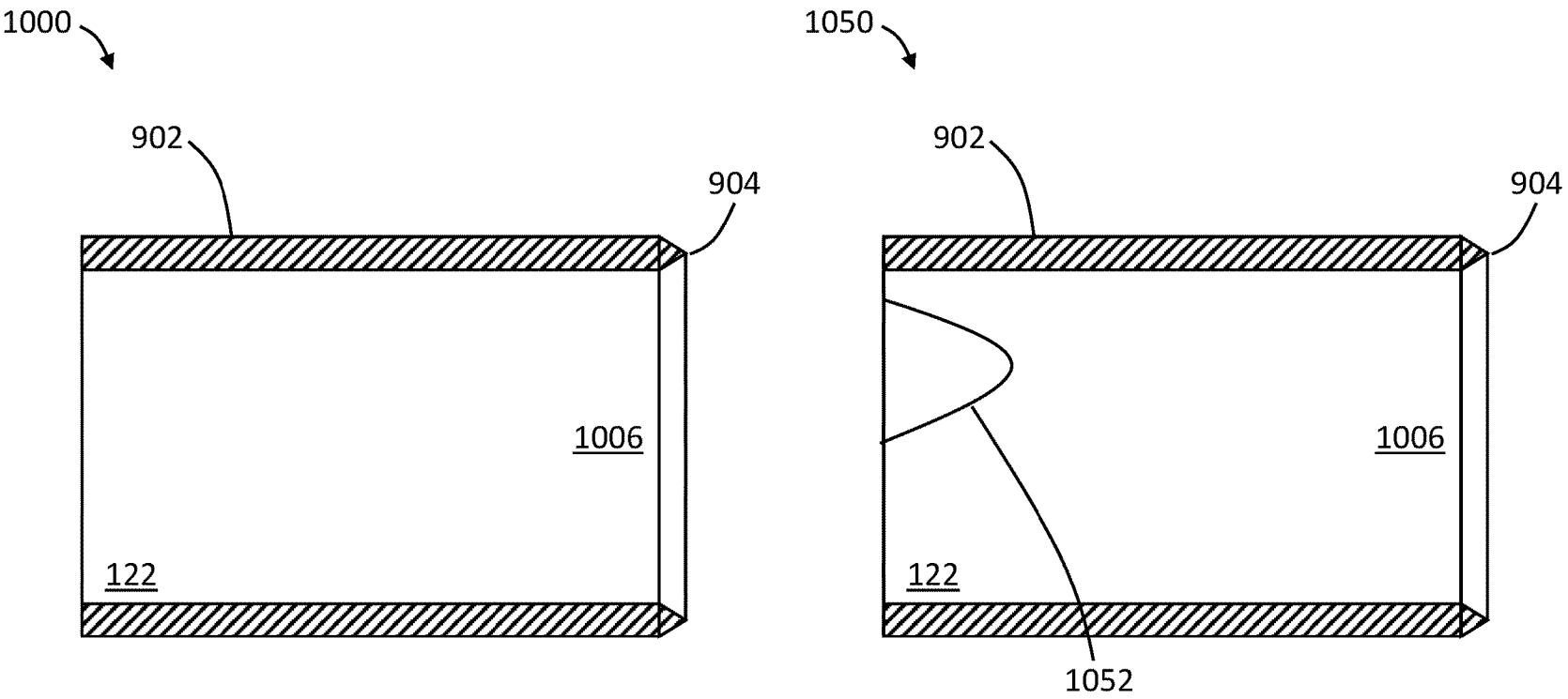
FIG. 10 depicts a cross-sectional diagram of coring heads having a sharpened leading edge and a hollow body in accordance with an illustrative embodiment.

FIG. 10 depicts a cross-sectional diagram of coring arrowheads 1000, 1050 having a sharpened leading edge and a hollow body for the passage of material in accordance with an illustrative embodiment. Coring arrowhead 1000 includes a hollow region 1006 for the passage of mass and fluid as described in FIG. 9. The mass and fluid pass through the coring arrowhead 1000 upon impact and is moved to another area, including either within the animal or to a hollow portion of the leading arrow body 110 of FIG. 1.

In another embodiment, the vented coring arrowhead 1050 includes one or more exit holes 1052 to allow matter and fluids to flow though the vented coring arrowhead 1050. The exit holes 1052 can be sized to make it, more or less restrictive to the passage of material though the arrowhead. According to some embodiments, the vented coring arrowhead 1050 is also hollow, thus allowing the passage of, material both through the exit holes 1052 and into the proximate end of the leading arrow body 110. Thus described, both the coring, arrowhead 1000 and the vented coring arrowhead 1050 cuts a roughly cylindrical hole through the target animal. The arrowheads 1000, 1050 also allows for the passage of material through the arrowhead 1000, 1050 and to either/both the leading arrow body 110 and the exit holes 1052.

Figure 11A:
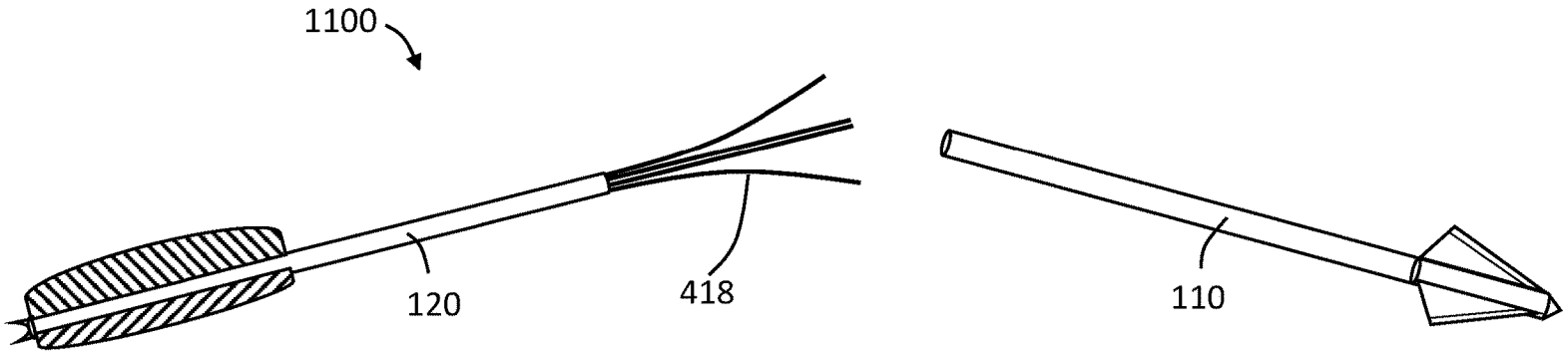
FIGS. 11A & 11B depicts an arrow having leading and lagging body elements and containing one or more rods in accordance with an illustrative embodiment.
Figure 11B:
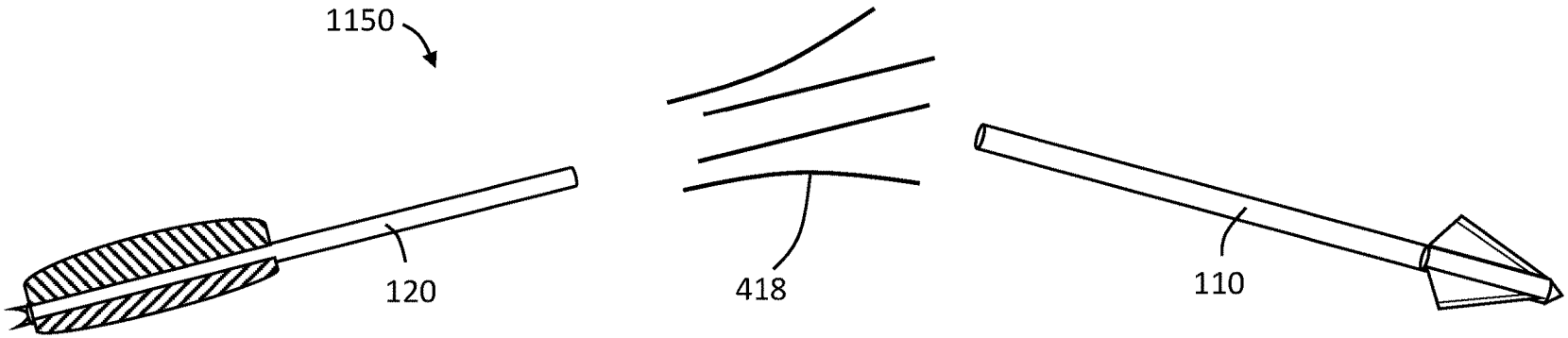

FIGS. 11A & 11B depicts arrows having led and lagging body elements and containing one or more rods 1100, 1150 in accordance with an illustrative embodiment. Arrow 1100 includes leading arrow 110 and lagging arrow 120 of FIG. 1 and includes one or more rods 418 fixably attached to the lagging arrow 120. Likewise, arrow 1150 includes leading arrow 110 and lagging arrow 120 of FIG. 1 and includes one or more rods 418 that are released from the lagging arrow 120 upon impact with a target animal.

For both arrow 1100 and arrow 1150, the functioning of the rods 418 is similar. Each rod is positioned within the leading arrow 110 and the lagging arrow 120 and is, hidden from view while the arrow 1100, 1050 is at rest. Once shot from a bow and upon impact, the leading arrow 110 continues along its trajectory and separates from the lagging Arrow 120 as described herein. Once separated, the rods 418 are exposed to the target animal while still travelling forward. Each rod 418 can be either flexible or inflexible. Also, each rod 418 can be flat faced, sharpened, or hollow. In every case, each rod 418 will create its own wound cavity within the animal and also contribute significantly to the deceleration of the lagging arrow 120. In the case of arrow 1150 with rods 418 that are released upon impact, each rod 418 can take a unique path through the target animal and cause significant additional damage. According to some embodiments, arrow 1100 can include both a coring arrowhead 902 and one or more rods 418 to create significant additional damage to the animal though a larger wound cavity.

Figure 12:
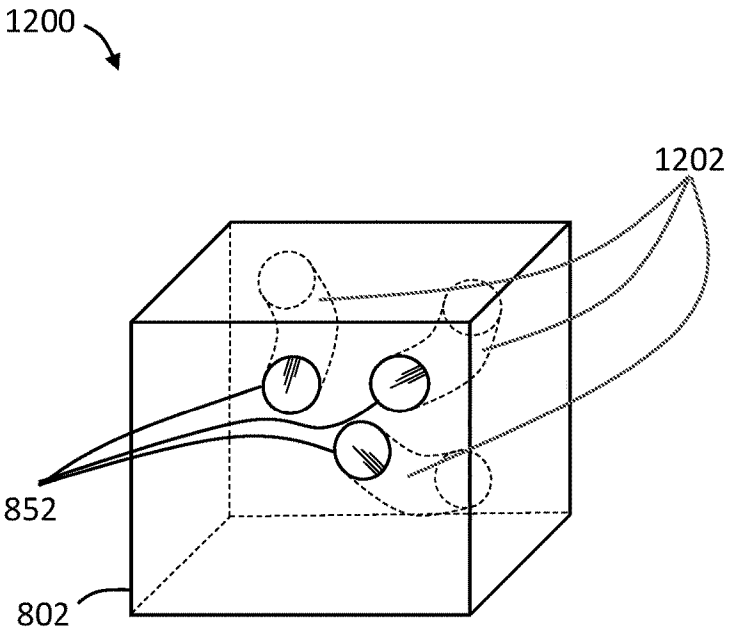
FIG. 12 depicts multiple wound cavities caused by a target animal being hit with several rods simultaneously in accordance with an illustrative embodiment.

FIG. 12 depicts multiple wound cavities 1200 caused by a target animal being hit with several rods 418 simultaneously in accordance with an illustrative embodiment. Each rod 418 creates a roughly cylindrical wound entrance hole (depending on the shape of the rod 418). Since each rod 418 takes a unique individualized path through the target animal, each wound path 1202 has a greater potential to hit a vital organ or artery. According to some embodiments, the rods can also be shaped in different configurations, such as T-shaped, hollow, U-shaped, square, and the like. Thus, the associated wound impact 852 would take the approximate form of the cross-sectional shape of the rod 418.

According to some embodiments, the multiple wound paths 1202 would combine to form an exceptionally large open wound cavity as described in FIG. 8. Thus formed, the open wound cavity 1202 would result in massive bleeding of the target animal and a higher likelihood of hitting a vital organ or artery. Likewise, the animal would experience a higher probability of very rapid blood loss, reduced suffering, and a lower probability of escaping while wounded.

According to some embodiments, the coring arrow also includes a sabot in place of an arrow head, where the sabot provides an aerodynamic shape for the coring arrow in flight. In yet other embodiments, the sabot breaks away prior to impact with the animal, while in yet other embodiments, the sabot breaks away after impact with an animal. In some embodiments, the sabot also protects the leading edge of the coring arrow for safe handling and transport of the arrow. According to some embodiments, the sabot breaks away due to aerodynamic forces and/or centrifugal forces while the arrow 100 is in flight.

The foregoing outlines features of several embodiments so that those of ordinary skill in the art may better understand various aspects of the present disclosure. Those of ordinary skill in the art should appreciate that they may readily use the present disclosure as a basis for designing or modifying other processes and structures for carrying out the same purposes or achieving the same advantages of various embodiments introduced herein. Those of ordinary skill in the art should also realize that such equivalent constructions do not depart from the spirit and scope of the present disclosure, and that they may make various changes, substitutions, and alterations herein without departing from the spirit and scope of the present disclosure.

Although the subject matter has been described in language specific to structural features or methodological acts, it is to be understood that the subject matter of the appended claims is not necessarily limited to the specific features or acts described above. Rather, the specific features and acts described above are disclosed as example forms of implementing at least some of the claims.

Various operations of embodiments are provided herein. The order in which some or all of the operations are described should not be construed to imply that these operations arc necessarily order dependent. Alternative ordering will be appreciated having the benefit of this description. Further, it will be understood that not all operations are necessarily present in each embodiment provided herein. Also, it will be understood that not all operations are necessary in some embodiments.

As used in this application, "or" is intended to mean an inclusive "or" rather than an exclusive "or". In addition, "a" and "an" as used in this application and the appended claims are generally be construed to mean "one or more" unless specified otherwise or clear from context to be directed to a singular form. Also, at least one of A and B and/or the like generally means A or B or both A and B. Furthermore, to the extent that "includes", "having", "has", "with", or variants thereof are used, such terms are intended to be inclusive in a manner similar to the term "comprising". Also, unless specified otherwise, "first," "second," or the like are not intended to imply a temporal aspect, a spatial aspect, an ordering, etc. Rather, such terms are merely used as identifiers, names, etc. for features, elements, items, etc. For example, a first element and a second element generally correspond to element A and element B or two different or two identical elements or the same element.

Also, although the disclosure has been shown and described with respect to one or more implementations, equivalent alterations and modifications will occur to others of ordinary skill in the art based upon a reading and understanding of this specification and the annexed drawings. The disclosure includes all such modifications and alterations and is limited only by the scope of the following claims. In particular regard to the various functions performed by the above-described components the terms used to describe such components are intended to correspond, unless otherwise indicated, to any component which performs the specified function of the described component (for example, a term that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above, with regard to specific embodiments. However, the benefits, advantages, solutions to problems, and any feature(s) that may cause any benefit, advantage, or solution to occur or become more pronounced are not to be construed as a critical, required, or essential feature of any or all the, claims. Moreover, the particular embodiments disclosed above are illustrative only, as the disclosed subject matter may be modified and practiced in different but equivalent manners apparent to those skilled in the art having the benefit of the teachings herein. No limitations are intended to the details of construction or design herein shown, other than as described in the claims below. It is therefore evident that the particular embodiments disclosed above may be altered or modified and all such variations are considered within the scope of the disclosed subject matter. Accordingly, the protection sought herein is as set forth in the claims below.

What is claimed is:

1. An arrow device, comprising:

a first body comprising a cylindrical member with a first outside diameter, a first outer surface, a first inner diameter, a first proximate end, and a first distal end, wherein the first proximate end. is mechanically configured to accept an arrowhead;

a second body comprising a hollow cylindrical member with a second outside diameter, a second inner diameter, a second outer surface, a second inner surface, a second proximate end, and a second distal end, wherein the second distal end is mechanically configured to accept fletching mechanically fastened to the second outside surface, and wherein the second body is mechanically configured to accept a nock positioned at the second distal end; and wherein the second body is constructed of stranded spiral elements that withstand aerodynamic forces during flight and break apart during impact with a target, thus increasing a drag value of the second body after impact with the target, wherein, responsive to the arrow hitting the target, the first body travels through the target and the second body stops within the target;

one or more rods positioned within the second body, wherein the rods arc exposed to the target after the first body detaches from the second body; and a connecting means to couple the first distal end of the first body to the second proximate end of the second body, wherein the connecting moans is configured to establish linear alignment of the first body to the second body along the device's longitudinal axis, and wherein the connecting means permits the first body to be removable in relation to the second body responsive to hitting the target with the arrow.

2. The device of claim 1, wherein the arrowhead is a hollow coring arrowhead configured to cut a volume of material through a. target, and wherein mass and fluid passes through the coring arrowhead to the first body.

3. The device of claim 1, wherein the arrowhead is a hollow coring arrowhead configured to cut a volume of material through a target, and wherein mass and fluid passes through the coring arrowhead and out an exit hole in the arrowhead.

4. The device of claim 1, wherein the rods arc flexible and spread out in a random direction upon impact with the target, and wherein the rods each creates an individual wound cavity.

5. The device of claim 1, wherein the rods arc fixably attached to the second body and are retained with the second body after the second body stops moving within the target.

6. The device of claim 1, wherein the rods are released upon impact and travel within the target, and wherein each rod creates an individual wound cavity.

7. The device of claim 1, wherein, responsive to the first outer diameter being smaller than the second inner diameter, the first body is positioned within the second body to form a coaxial and concentric arrangement of the first body to the second body along the device's longitudinal axis.

8. The device of claim 1, wherein, responsive to the first inner diameter being larger than the second outer diameter, the second body is positioned within the first body to form a coaxial and concentric arrangement of the first body to the second body along the device's longitudinal axis.

9. The device of claim 1, wherein the orientation of the stranded spiral elements of the second body is positioned at an angle relative to the fletching in such a way that centrifugal forces imparted on the arrow by the orientation of the fletching contributes to destruction of the stranded spiral elements, and thus the second body, wherein the centrifugal inertia of the arrow aids in tearing apart the stranded spiral elements.

10. The device of claim 1, further comprising:

a first drag value associated with the first body; and a second drag value associated with the second body, wherein the second drag value is larger than the first drag value, and wherein the second drag value permits the second body to decelerate upon impact with the target.

11. The device of claim 1, wherein the connecting means is comprised of a supporting member that uses at least one clement of a set comprising an O-ring, a friction-fit arrangement, adhesives, an interference-fit arrangement, a shear pin, springs, threads, and fastening tape to mechanically fasten the first body to the second body.

12. The device of claim 1, wherein the stranded spiral elements arc constructed with known and deliberate weak points to aid in defining break points within the second body, and wherein can be made of at least one subset of a set comprising glue, thin material, laser or other mechanical indentations, perforations, and the like.

13. The device of claim 1, further comprising a fluid conduit formed by the hollow cylindrical member of the second body, wherein a plurality of holes are placed along the length of the second body, and wherein the hole edges are sharpened to aid in cutting material from a wound cavity while the second body is moving through the target, and wherein the second proximate end and the plurality of holes acts as intake openings, and the second distal end acts as a discharge opening for material passage and blood flow.

14. A system for dispatching an animal, comprising:

a bow for shooting arrows; and an arrow device, comprising;

a first body comprising a cylindrical member with a first outside diameter, a first outer surface, a first inner diameter, a first proximate end, and a first distal end, wherein the first proximate end is mechanically configured to accept an arrowhead;

a second body comprising a hollow cylindrical member with a second outside diameter, a second inner diameter, a second outer surface, a second inner surface, a second proximate end, and a second distal end, wherein the second distal end is mechanically configured to accept fletching mechanically fastened to the second outside surface, and wherein the second body is mechanically configured to accept a nock positioned at the second distal end;

the second body is constructed of stranded spiral elements that withstand aerodynamic forces during flight and break apart during impact with a target, thus increasing a drag value of the second body after impact with the target, wherein, responsive to the arrow hitting the target, the first body travels through the target and the second body stops within the target; and a connecting means to couple the first distal end of the first body to the second proximate end of the second body, wherein the connecting means is configured to establish linear alignment of the first body to the second body along the device's longitudinal axis, and wherein the connecting means permits the first body to be removable in relation to the second body responsive to hitting the animal with the arrow.

15. The system of claim 14, wherein the arrowhead is a hollow coring arrowhead configured to cut a volume of material through a target, and wherein mass and fluid passes through the coring arrowhead to the first body.

16. The system of claim 14, further comprising one or more rods positioned within the second body, wherein the rods are exposed to the target after the first body detaches from the second body.

17. A method for rapid dispatching of an animal, comprising:

hitting the animal with an arrow, wherein the arrow comprises:

a first body comprising a cylindrical member with a first outside diameter, a first outer surface, a first inner diameter, a first proximate end, and a first distal end, wherein the first proximate end is mechanically configured to accept an arrowhead;

a second body comprising a hollow cylindrical member with a second outside diameter, a second inner diameter, a second outer surface, a second inner surface, a second proximate end, and a second distal end, wherein the second distal end is mechanically configured to accept fletching mechanically fastened to the second outside surface, and wherein the second body is mechanically configured to accept a nock positioned at the second distal end;

the second body is constructed of stranded spiral elements that withstand aerodynamic forces during flight and break apart during impact with a target, thus increasing a drag value of the second body after impact with the target, wherein, responsive to the arrow hitting the target, the first body travels through the target and the second body stops within the target;

one or more rods positioned within the second body, wherein the rods are exposed to the target after the first body detaches from the second body; and a connecting means to couple the first distal end of the first body to the second proximate end of the second body, wherein the connecting means is configured to establish linear alignment of the first body to the second body along the device's longitudinal axis, and wherein the connecting means permits the first body to be removable in relation to the second body responsive to hitting the animal with the arrow;

and penetrating, by the arrowhead, the animal, wherein the arrowhead causes tissue damage and creates a wound cavity with associated blood loss;

responsive to the arrow hitting the animal, decelerating, by the second body, wherein the second body maintains the wound cavity to prevent closure of the wound cavity;

separating the first body from the second body, wherein the first body separates due to a lower drag value than a drag value of the second body; and dispatching of the animal due to the wound cavity and associated blood loss.

18. The method of claim 17, wherein the arrowhead is a hollow coring arrowhead configured to cut a volume of material through a target, and wherein mass and fluid passes through the coring arrowhead to the first body.

* * * * *